United States Patent [19]

Gerson

[11] Patent Number: 4,896,361

[45] Date of Patent: Jan. 23, 1990

[54] DIGITAL SPEECH CODER HAVING IMPROVED VECTOR EXCITATION SOURCE

[75] Inventor: Ira A. Gerson, Hoffman Estates, Ill.

[73] Assignee: Motorola, Inc., Schaumburg, Ill.

[21] Appl. No.: 294,098

[22] Filed: Jan. 6, 1989

Related U.S. Application Data

[63] Continuation of Ser. No. 141,446, Jan. 7, 1988, Pat. No. 4,817,157.

[51] Int. Cl.[4] ..... G10L 5/00

[52] U.S. Cl. ..... 381/40; 381/49

[58] Field of Search ..... 381/40, 49

[56] References Cited

U.S. PATENT DOCUMENTS

| | | | |
|---|---|---|---|
| 3,631,520 | 12/1971 | Atal | 179/1 SA |
| 4,133,976 | 1/1979 | Atal et al. | 179/1 P |
| 4,220,819 | 9/1980 | Atal | 179/1 SA |
| 4,472,832 | 8/1984 | Atal et al. | 381/40 |
| 4,817,157 | 3/1989 | Gerson | 381/40 |

FOREIGN PATENT DOCUMENTS 1222568 6/1987 Canada .

OTHER PUBLICATIONS

Makhoul et al, "Vector Quantization in Speech Coding", *Proc. of IEEE,* vol. 73, No. 11, Nov. 1985, pp. 1551–1588.

Chen et al., "Real-Time Vector APC Speech Coding at 4800 BPS with Adaptive Postfiltering", *ICASSP* 87 (International Conference on Acoustics, Speech & Signal Processing), Apr. 1987, vol. 4, IEEE, pp. 2185–2188.

Atal, B. S., "Predictive Coding of Speech at Low Bit Rates", *IEEE Transactions on Communications,* vol. COM-30, No. 4 (Apr. 1982), pp. 600–614.

Atal, B. S., "Stochastic Coding of Speech Signals at Very Low Bit Rates", *Proc. Int. Conf. Commun.,* vol. 3, Paper No. 48.1 (May 14–17, 1984).

Davidson, G., and Gersho, A., "Complexity Reduction Methods for Vector Excitation Coding", *IEEE-IECE-J-ASJ International Conference on Acoustics, Speech, and Signal Processing,* vol. 4 (Apr. 7–11, 1986), pp. 3055–3058.

Kabal, P., "Code Excited Linear Prediction Coding of Speech at 4.8 kb/s", *INRS-Telecommunications Technical Report,* No. 87-36 (Jul. 1987), pp. 1–16.

Kroon, P., Deprettere, E. F., and Sluyter, R. J., "Regular-Pulse Excitation-A Novel Approach to Effective and Efficient Multipulse Coding of Speech", *IEEE Transactions on Acoustics, Speech, and Signal Processing,* vol. ASSP-34, No. 5 (Oct. 1986), pp. 1054–1063.

Lin, Daniel, "Speech Coding Using Efficient Pseudo-Stochastic Block Codes", *IEEE International Conference on Acoustics, Speech and Signal Processing,* vol. 3 (Apr. 6–9, 1987), pp. 1354–1357.

Moncet, J. L., and Kabal, P., "Codeword Selection for CELP Coders", *INRS-Telecommunications Technical Report,* No. 87-35, (Jul. 1987), pp. 1–22.

Schroeder, M. R., and Atal, B. S., "Code-Excited Linear Prediction (CELP): High-Quality Speech at Very Low Bit Rates", *Proc. IEEE International Conference on Acoustics, Speech and Signal Processing,* vol. 3 (Mar. 26–29, 1985), pp. 937–940.

(List continued on next page.)

*Primary Examiner*—Emanuel S. Kemeny

*Attorney, Agent, or Firm*—Steven G. Parmelee; Charles L. Warren

[57] ABSTRACT

An improved excitation vector generation and search technique (FIG. 1) is described for a code-excited linear prediction (CELP) speech coder (100) using a codebook memory of excitation code vectors. A set of M basis vectors $v_m(n)$ are used along with the excitation signal codewords (i) to generate the codebook of excitation vectors $u_i(n)$ according to a "vector sum" technique (120) of converting stored selector codewords into a plurality of interim data signals, multiplying the set of M basis vectors by the interim data signals, and summing the resultant vectors to produce the set of $2^M$ codebook vectors. Only M basis vectors need to be stored in memory (114), as opposed to all $2^M$ code vectors.

12 Claims, 11 Drawing Sheets

OTHER PUBLICATIONS

Schroeder, M. R., "Linear Predictive Coding of Speech: Review and Current Directions", *IEEE Communications Magazine,* vol. 23, No. 8 (Aug. 1985), pp. 54–61.

Schroeder, M. R., and Sloane, N. J. A., "New Permutation Codes Using Hadamard Unscrambling", *IEEE Transactions on Information Theory,* vol. IT-33, No. 1 (Jan. 1987), pp. 144–146.

Trancoso, I. M., and Atal, B. S., "Efficient Procedures for Finding the Optimum Innovation in Stochastic Coders", *IEEE International Conference on Acoustics, Speech, and Signal Processing,* vol. 4 (Apr. 7–11, 1986), pp. 2375–2378.

Gerson, co-pending U.S. patent application Ser. No. 212,455, filed Jun. 30, 1988 (Attorney Docket No. CM0045OH).

DIGITAL SPEECH CODER HAVING IMPROVED VECTOR EXCITATION SOURCE

CROSS REFERENCE TO RELATED APPLICATIONS

This application is a continuation of Application Ser. No. 07/141,446, filed Jan. 7, 1988, and assigned to the same Assignee as the present invention.

BACKGROUND OF THE INVENTION

The present invention generally relates to digital speech coding at low bit rates, and more particularly, is directed to an improved method for coding the excitation information for code-excited linear predictive speech coders.

Code-excited linear prediction (CELP) is a speech coding technique which has the potential of producing high quality synthesized speech at low bit rates, i.e., 4.8 to 9.6 kilobits-per-second (kbps). This class of speech coding, also known as vector-excited linear prediction or stochastic coding, will most likely be used in numerous speech communications and speech synthesis applications. CELP may prove to be particularly applicable to digital speech encryption and digital radiotelephone communication systems wherein speech quality, data rate, size, and cost are significant issues.

In a CELP speech coder, the long term ("pitch") and short term ("formant") predictors which model the characteristics of the input speech signal are incorporated in a set of time-varying linear filters. An excitation signal for the filters is chosen from a codebook of stored innovation sequences, or code vectors. For each frame of speech, the speech coder applies each individual code vector to the filters to generate a reconstructed speech signal, and compares the original input speech signal to the reconstructed signal to create an error signal. The error signal is then weighted by passing it through a weighting filter having a response based on human auditory perception. The optimum excitation signal is determined by selecting the code vector which produces the weighted error signal with the minimum energy for the current frame The term "code-excited" or "vector-excited" is derived from the fact that the excitation sequence for the speech coder is vector quantized, i.e., a single codeword is used to represent a sequence, or vector, of excitation samples. In this way, data rates of less than one bit per sample are possible for coding the excitation sequence. The stored excitation code vectors generally consist of independent random white Gaussian sequences. One code vector from the codebook is used to represent each block of N excitation samples. Each stored code vector is represented by a codeword, i.e., the address of the code vector memory location. It is this codeword that is subsequently sent over a communications channel to the speech synthesizer to reconstruct the speech frame at the receiver. See M. R. Schroeder and B. S. Atal, "Code-Excited Linear Prediction (CELP): High-Quality Speech at Very Low Bit Rates", *Proceedings of the IEEE International Conference on Acoustics, Speech and Signal Processing* (*ICASSP*), Vol. 3, pp. 937–40, March 1985, for a detailed explanation of CETP.

The difficulty of the CETP speech coding technique lies in the extremely high computational complexity of performing an exhaustive search of all the excitation code vectors in the codebook. For example, at a sampling rate of 8 kilohertz (kHz), a 5 millisecond (msec) frame of speech would consist of 40 samples. If the excitation information were coded at a rate of 0.25 bits per sample (corresponding to 2 kbps), then 10 bits of information are used to code each frame. Hence, the random codebook would then contain $2^{10}$, or 1024, random code vectors. The vector search procedure requires approximately 15 multiply-accumulate (MAC) computations (assuming a third order long-term predictor and a tenth order short-term predictor) for each of the 40 samples in each code vector. This corresponds to 600 MACs per code vector per 5 msec speech frame, or approximately 120,000,000 MACs per second (600 MACs/5 msec frame$\times$1024 code vectors). One can now appreciate the extraordinary computational effort required to search the entire codebook of 1024 vectors for the best fit—an unreasonable task for real-time implementation with today's digital signal processing technology.

Moreover, the memory allocation requirement to store the codebook of independent random vectors is also exorbitant. For the above example, a 640 kilobit read-only-memory (ROM) would be required to store all 1024 code vectors, each having 40 samples, each sample represented by a 16-bit word. This ROM size requirement is inconsistent with the size and cost goals of many speech coding applications. Hence, prior art code excited linear prediction is presently not a practical approach to speech coding.

One alternative for reducing the computational complexity of this code vector search process is to implement the search calculations in a transform domain. Refer to I. M. Trancoso and B. S. Atal, "Efficient Procedures for Finding the Optimum Innovation in Stochastic Coders", *Proc. ICASSP*, Vol. 4, pp. 2375–8, April 1986, as an example of such a procedure. Using this approach, discrete Fourier transforms (DFT's) or other transforms may be used to express the filter response in the transform domain such that the filter computations are reduced to a single MAC operation per sample per code vector. However, an additional 2 MACs per sample per code vector are also required to evaluate the code vector, thus resulting in a substantial number of multiply-accumulate operations, i.e., 120 per code vector per 5 msec frame, or 24,000,000 MACs per second in the above example. Still further, the transform approach requires at least twice the amount of memory, since the transform of each code vector must also be stored. In the above example, a 1.3 Megabit ROM would be required for implementing CELP using transforms.

A second approach for reducing the computational complexity is to structure the excitation codebook such that the code vectors are no longer independent of each other. In this manner, the filtered version of a code vector can be computed from the filtered version of the previous code vector, again using only a single filter computation MAC per sample. This approach results in approximately the same computational requirements as transform techniques, i.e., 24,000,000 MACs per second, while significantly reducing the amount of ROM required (16 kilobits in the above example). Examples of these types of codebooks are given in the article entitled "Speech Coding Using Efficient Pseudo-Stochastic Block Codes", *Proc. ICASSP*, Vol. 3, pp. 1354–7, April 1987, by D. Lin. Nevertheless, 24,000,000 MACs per second is presently beyond the computational capability of a single DSP. Moreover, the ROM size is based on $2^M \times$ #bits/word, where M is the number of bits in the codeword such that the codebook contains $2^M$ code victors. Therefore, the memory requirements still increase exponentially with the number of bits used to encode the frame of excitation information. For example, the ROM requirements increase to 64 kilobits when using 12 bit codewords.

A need, therefore, exists to provide an improved speech coding technique that addresses both the problems of extremely high computational complexity for exhaustive codebook searching, as well as the vast memory requirements for storing the excitation code vectors.

SUMMARY OF THE INVENTION

Accordingly, a general object of the present invention is to provide an improved digital speech coding technique that produces high quality speech at low bit rates.

Another object of the present invention is to provide an efficient excitation vector generating technique having reduced memory requirements.

A further object of the present invention is to provide an improved codebook searching technique having reduced computation complexity for practical implementation in real time utilizing today's digital signal processing technology.

These and other objects are achieved by the present invention, which, briefly described, is an improved excitation vector generation and search technique for a speech coder using a codebook having stored excitation code vectors. In accordance with the invention, a set of basis vectors are used along with the excitation signal codewords to generate the codebook of excitation vectors according to a novel "vector sum" technique. Apparatus which provides the set of $2^M$ codebook vectors comprises a memory which stores a set of selector codewords formed by . . ., converting the selector codewords into a plurality of interim data signals, generally based upon the value of each bit of each selector codeword; inputting a set of M basis vectors, typically stored in memory in place of storing the entire codebook; multiplying the set of M basis vectors by the plurality of interim data signals to produce a plurality of interim vectors; and summing the plurality of interim vectors to produce the set of $2^M$ code vectors means for addressing the memory with a particular codeword, and means for outputting a particular codebook vector from the memory when address with the particular codeword.

The "vector sum" codebook generation approach of the present invention permits faster implementation of CELP speech coding while retaining the advantages of high quality speech at low bit rates. More specifically, the present invention provides an effective solution to the problems of computational complexity and memory requirements. For example, the vector sum approach disclosed herein requires only M+3 MACs for each codework evaluation. In terms of the previous example, this corresponds to only 13 MACs, as opposed to 600 MACs for standard CELP or 120 MACs using the transform approach. This improvement translates into a reduction in complexity of approximately 10 times, resulting in approximately 2,600,000 MACs per second. This reduction in computational complexity makes possible practical real-time implementation of CELP using a single DSP.

Furthermore, only M basis vectors need to be stored in memory, as opposed to all $2^M$ code vectors. Hence, the ROM requirements for the above example are reduced from 640 kilobits to 6.4 kilobits for the present invention. Still another advantage to the present speech coding technique is that it is more robust to channel bit errors than standard CELP. Using the vector sum excited speech coder of the present invention, a single bit error in the received codeword will result in an excitation vector similar to the desired one Under the same conditions, standard CELP, using a random codebook, would yield an arbitrary excitation vector—entirely unrelated to the desired one.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like-referenced numerals identify like elements, and in which:

DETAILED DESCRIPTION OF THE PREFERRED EMBODIMENT

Figure 1:
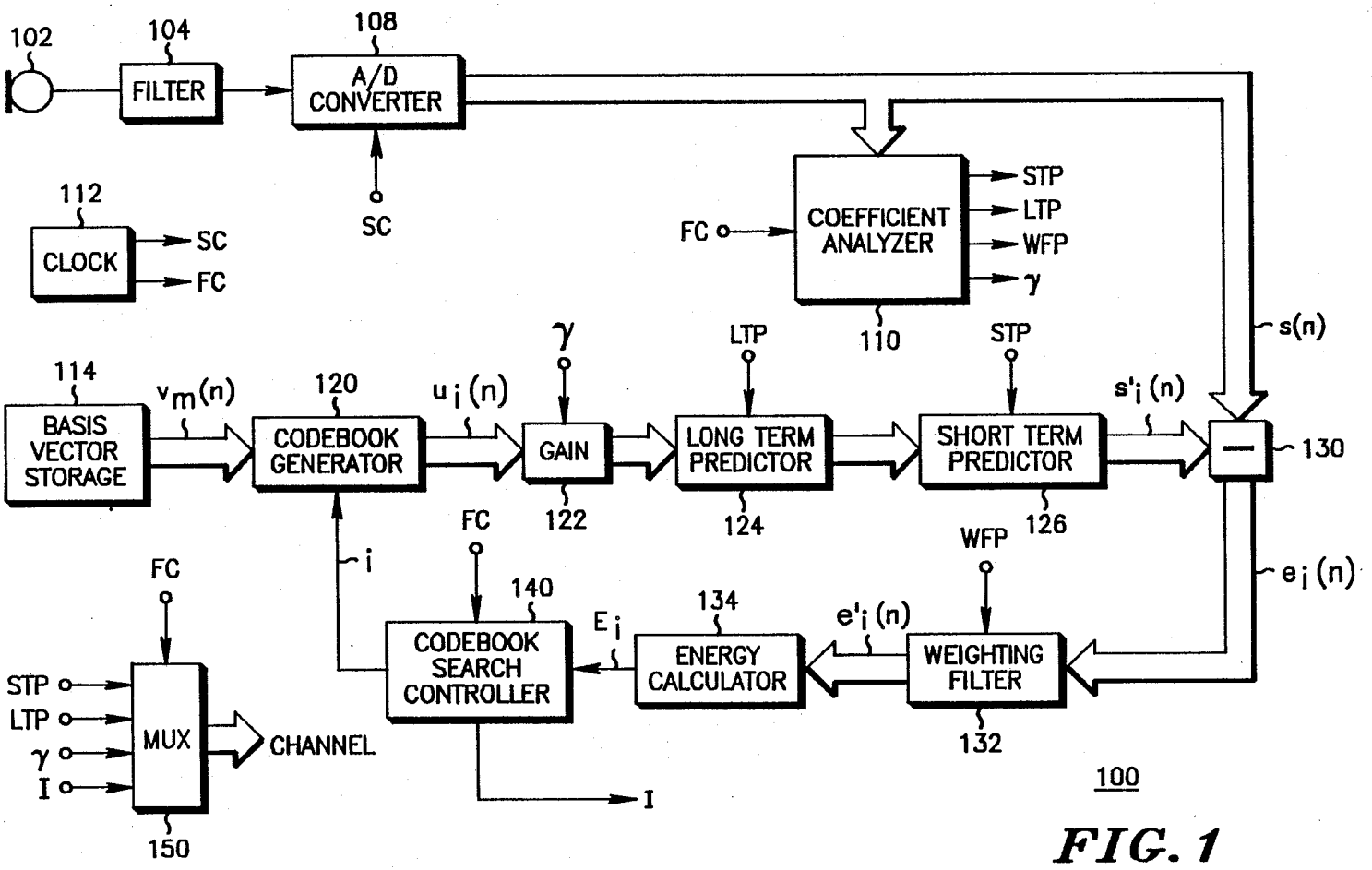
FIG. 1 is a general block diagram of a code excited linear predictive speech coder utilizing the vector sum excitation signal generation technique in accordance with the present invention.

Referring now to FIG. 1, there is shown a general block diagram of code excited linear predictive speech coder 100 utilizing the excitation signal generation technique according to the present invention. An acoustic input signal to be analyzed is applied to speech coder 100 at microphone 102. The input signal, typically a speech signal, is then applied to filter 104. Filter 104 generally will exhibit bandpass filter characteristics. However, if the speech bandwidth is already adequate, filter 104 may comprise a direct wire connection.

The analog speech signal from filter 104 is then converted into a sequence of N pulse samples, and the amplitude of each pulse sample is then represented by a digital code in analog-to-digital (A/D) converter 108, as known in the art. The sampling rate is determined by sample clock SC, which represents an 8.0 kHz rate in the preferred embodiment. The sample clock SC is generated along with the frame clock FC via clock 112.

The digital output of A/D 108, which may be represented as input speech vector s(n), is then applied to coefficient analyzer 110. This input speech vector s(n) is repetitively obtained in separate frames, i.e., blocks of time, the length of which is determined by the frame clock FC. In the preferred embodiment, input speech vector s(n), $1 \leqq n \leqq N$, represents a 5 msec frame containing N=40 samples, wherein each sample is represented by 12 to 16 bits of a digital code. For each block of speech, a set of linear predictive coding (LPC) parameters are produced in accordance with prior art techniques by coefficient analyzer 110. The short term predictor parameters STP, long term predictor parameters LTP, weighting filter parameters WFP, and excitation gain factor $\gamma$, (along with the best excitation codeword I as described later) are applied to multiplexer 150 and sent over the channel for use by the speech synthesizer. Refer to the article entitled "Predictive Coding of Speech at Low Bit Rates," *IEEE Trans. Commun.*, Vol. COM-30, pp. 600-14, April 1982, by B. S. Atal, for representative methods of generating these parameters. The input speech vector s(n) is also applied to subtractor 130, the function of which will subsequently be described.

Basis vector storage block 114 contains a set of M basis vectors $v_m(n)$, wherein $1 \leqq m \leqq M$, each comprised of N samples, wherein $1 \leqq n \leqq N$. These basis vectors are used by codebook generator 120 to generate a set of $2^M$ pseudo-random excitation vectors $u_i(n)$, wherein $0 \leqq i \leqq 2^m - 1$. Each of the M basis vectors are comprised of a series of random white Gaussian samples, although other types of basis vectors may be used with the present invention.

Codebook generator 120 utilizes the M basis vectors vm(n) and a set of $2^M$ excitation codewords $I_i$, where $0 \leqq i \leqq 2^M - 1$, to generate the $2^M$ excitation vectors $u_i(n)$. In the present embodiment, each codeword $I_i$ is equal to its index i, that is, $I_i = i$. If the excitation signal were coded at a rate of 0.25 bits per sample for each of the 40 samples (such that M=10), then there would be 10 basis vectors used to generate the 1024 excitation vectors. These excitation vectors are generated in accordance with the vector sum excitation technique, which will subsequently be described in accordance with FIGS. 2 and 3.

For each individual excitation vector $u_i(n)$, a reconstructed speech vector $s'_i(n)$ is generated for comparison to the input speech vector s(n). Gain block 122 scales the excitation vector $u_i(n)$ by the excitation gain factor $\gamma$, which is constant for the frame The excitation gain factor $\gamma$ may be precomputed by coefficient analyzer 110 and used to analyze all excitation vectors as shown in FIG. 1, or may be optimized jointly with the search for the best excitation codeword I and generated by codebook search controller 140. This optimized gain technique will subsequently be described in accordance with FIG. 5.

The scaled excitation signal $\gamma u_i(n)$ is then filtered by long term predictor filter 124 and short term predictor filter 126 to generate the reconstructed speech vector $s'_i(n)$. Filter 124 utilizes the long term predictor parameters LTP to introduce voice periodicity, and filter 126 utilizes the short term predictor parameters STP to introduce the spectral envelope. Note that blocks 124 and 126 are actually recursive filters which contain the long term predictor and short term predictor in their respective feedback paths. Refer to the previously mentioned article for representative transfer functions of these time-varying recursive filters.

The reconstructed speech vector $s'_i(n)$ for the i-th excitation code vector is compared to the same block of the input speech vector s(n) by subtracting these two signals in subtractor 130. The difference vector $e_i(n)$ represents the difference between the original and the reconstructed blocks of speech. The difference vector is perceptually weighted by weighting filter 132, utilizing the weighting filter parameters WTP generated by coefficient analyzer 110. Refer to the preceding referency for a representative weighting filter transfer function. Perceptual weighting accentuates those frequencies where the error is perceptually more important to the human ear, and attenuates other frequencies.

Energy calculator 134 computes the energy of the weighted difference vector $e'_i(n)$, and applies this error signal $E_i$ to codebook search controller 140. The search controller compares the i-th error signal for the present excitation vector $u_i(n)$ against previous error signals to determine the excitation vector producing the minimum error. The code of the i-th excitation vector having a minimum error is then output over the channel as the best excitation code I. In the alternative, search controller 140 may determine a particular codeword which provides an error signal having some predetermined criteria, such as meeting a predefined error threshold.

The operation of speech coder 100 will now be described in accordance with the flowchart of FIG. 2. Starting at step 200, a frame of N samples of input speech vector s(n) are obtained in step 202 and applied to subtractor 130. In the preferred embodiment, N=40 samples. In step 204, coefficient analyzer 110 computes the long term predictor parameters LTP, short term predictor parameters STP, weighting filter parameters WTP, and excitation gain factor 7. The filter states FS of long term predictor filter 124, short term predictor filter 126, and weighting filter 132, are then saved in step 206 for later use. Step 208 initializes variables i, representing the excitation codeword index, and $E_b$, representing the best error signal, as shown.

Continuing with step 210, the filter states for the long and short term predictors and the weighting filter are restored to those filter states saved in step 206. This restoration ensures that the previous filter history is the same for comparing each excitation vector. In step 212, the index i is then tested to see whether or not all excitation vectors have been compared. If i is less than $2^M$, then the operation continues for the next code vector. In step 214, the basis vectors $v_m(n)$ are used to compute the excitation vector $u_i(n)$ via the vector sum technique.

Figure 3:
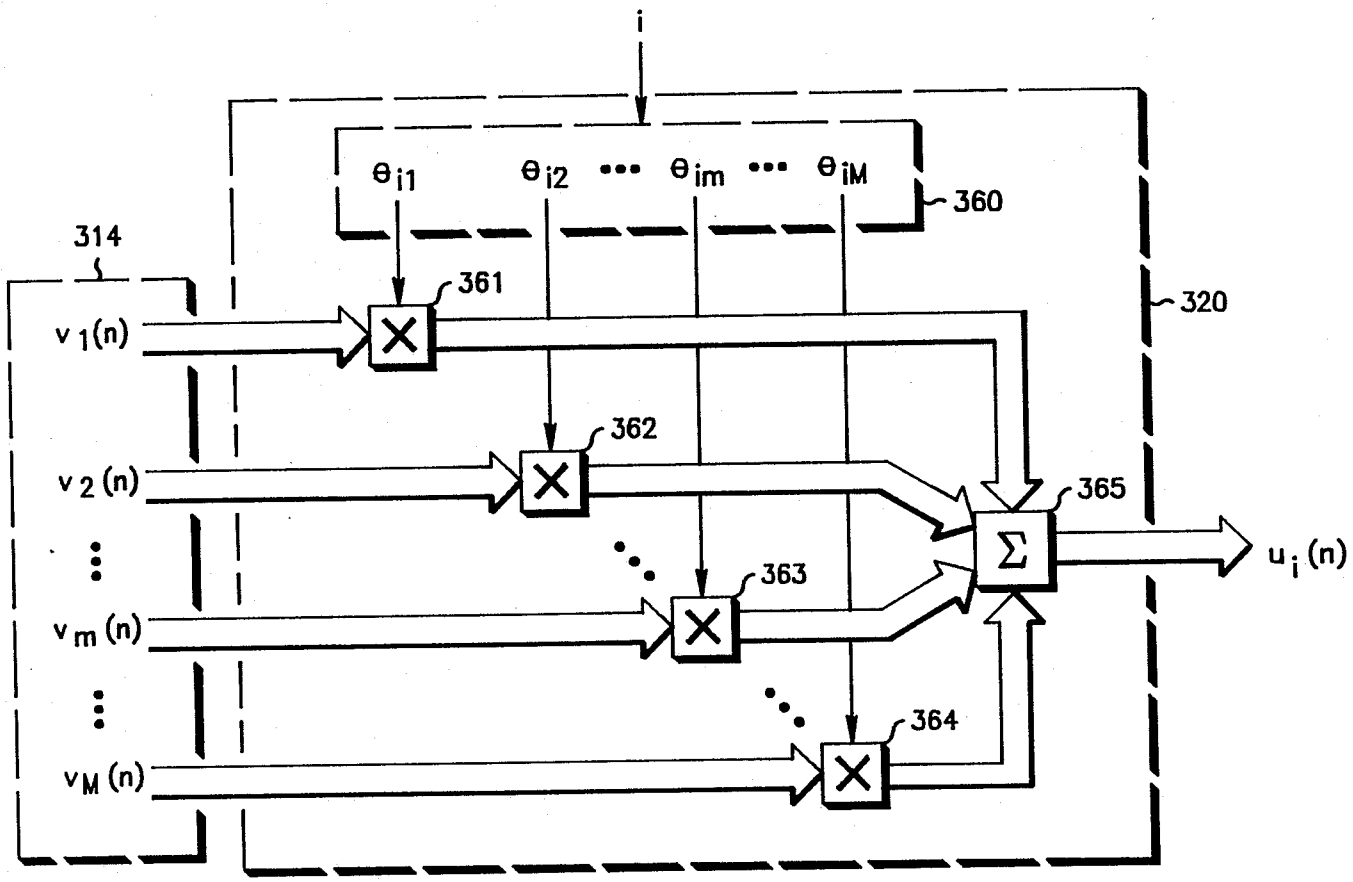
FIG. 3 is a detailed block diagram of the codebook generator block of FIG. 1, illustrating the vector sum technique of the present invention.

FIG. 3, illustrating a representative hardware configuration for codebook generator 120, will now be used to describe the vector sum technique. Generator block 320 corresponds to codebook generator 120 of FIG. 1, while memory 314 corresponds to basis vector storage 114. Memory block 314 stores all of the M basis vectors $v_1(n)$ through $v_M(n)$, wherein $1 \leqq m \leqq M$, and wherein $1 \leqq n \leqq N$. All M basis vectors are applied to multipliers 361 through 364 of generator 320.

The i-th excitation codeword is also applied to generator 320. This excitation information is then converted into a plurality of interim data signals $\theta_{i1}$ through $\theta_{iM}$, wherein $1 \leqq m \leqq M$, by converter 360. In the preferred embodiment, the interim data signals are based on the value of the individual bits of the selector codeword i, such that each interim data signal $\theta_{im}$ represents the sign corresponding to the m-th bit bit of the i-th excitation codeword. For example, if bit one of excitation codeword i is 0, then $\theta_{i1}$ would be $-1$. Similarly, if the second bit of excitation codeword i is 1, then $\theta_{i2}$ would be +1. It is contemplated, however, that the interim data signals may alternatively be any other transformation from i to $\theta_{im}$, e.g., as determined by a ROM look-up table. Also note that the number of bits in the codeword do not have to be the same as the number of basis vectors. For example, codeword i could have 2M bits where each pair of bits defines 4 values for each $\theta_{im}$, i.e., 0, 1, 2, 3, or +1, −1, +2, −2, etc.

The interim data signals are also applied to multipliers 361 through 364. The multipliers are used to multiply the set of basis vectors $v_m(n)$ by the set of interim data signals $\theta_{im}$ to produce a set of interim vectors which are then summed together in summation network 365 to produce the single excitation code vector $u_i(n)$. Hence, the vector sum technique is described by the equation:

$$u_i(n) = \sum_{m=1}^{M} \theta_{im}\, v_m(n) \qquad \{1\}$$

where $u_i(n)$ is the n-th sample of the i-th excitation code vector, and where $1 \leqq n \leqq N$.

Figure 2A:
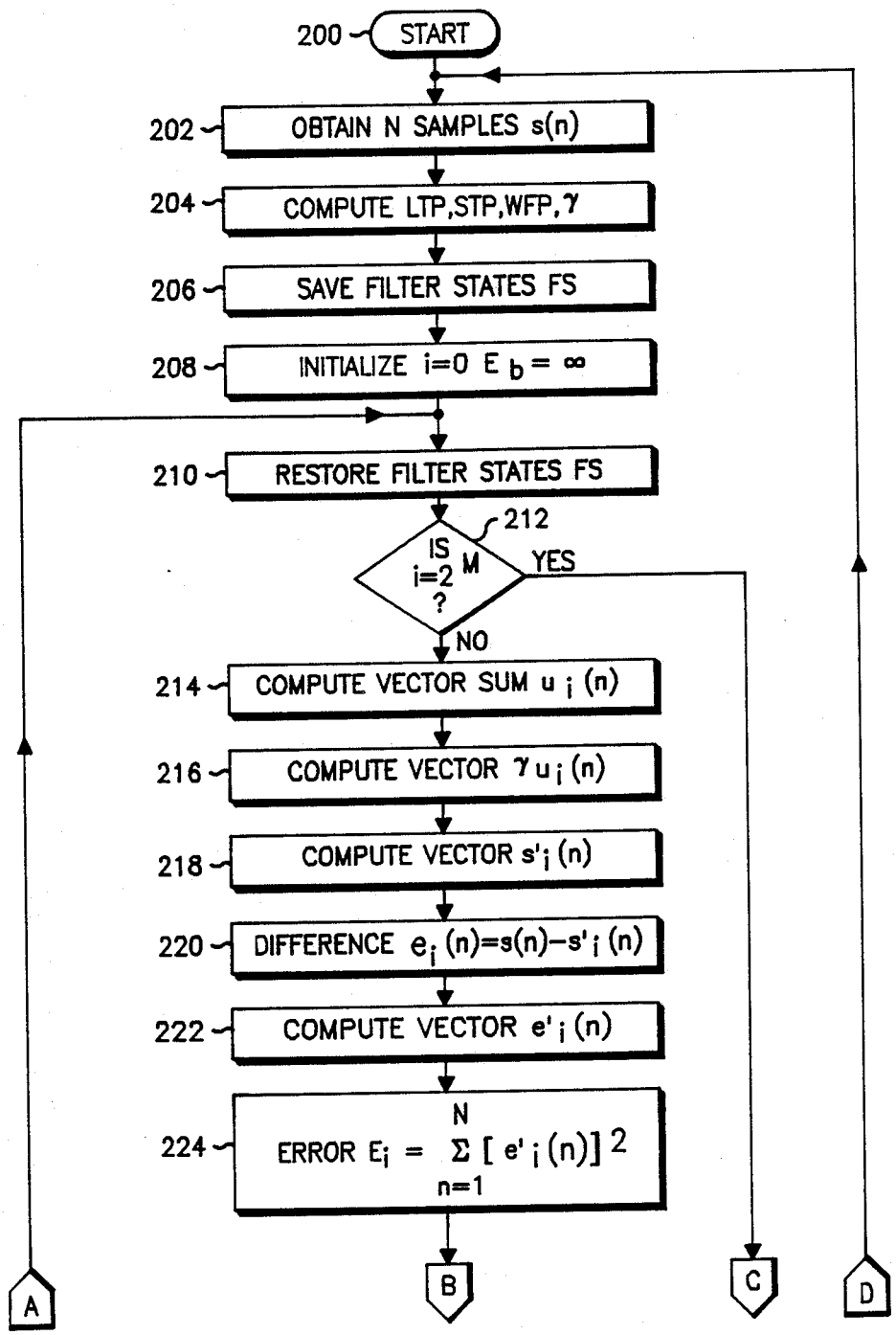
FIGS. 2A/2B is a simplified flowchart diagram illustrating the general sequence of operations performed by the speech coder of FIG. 1.
Figure 2B:
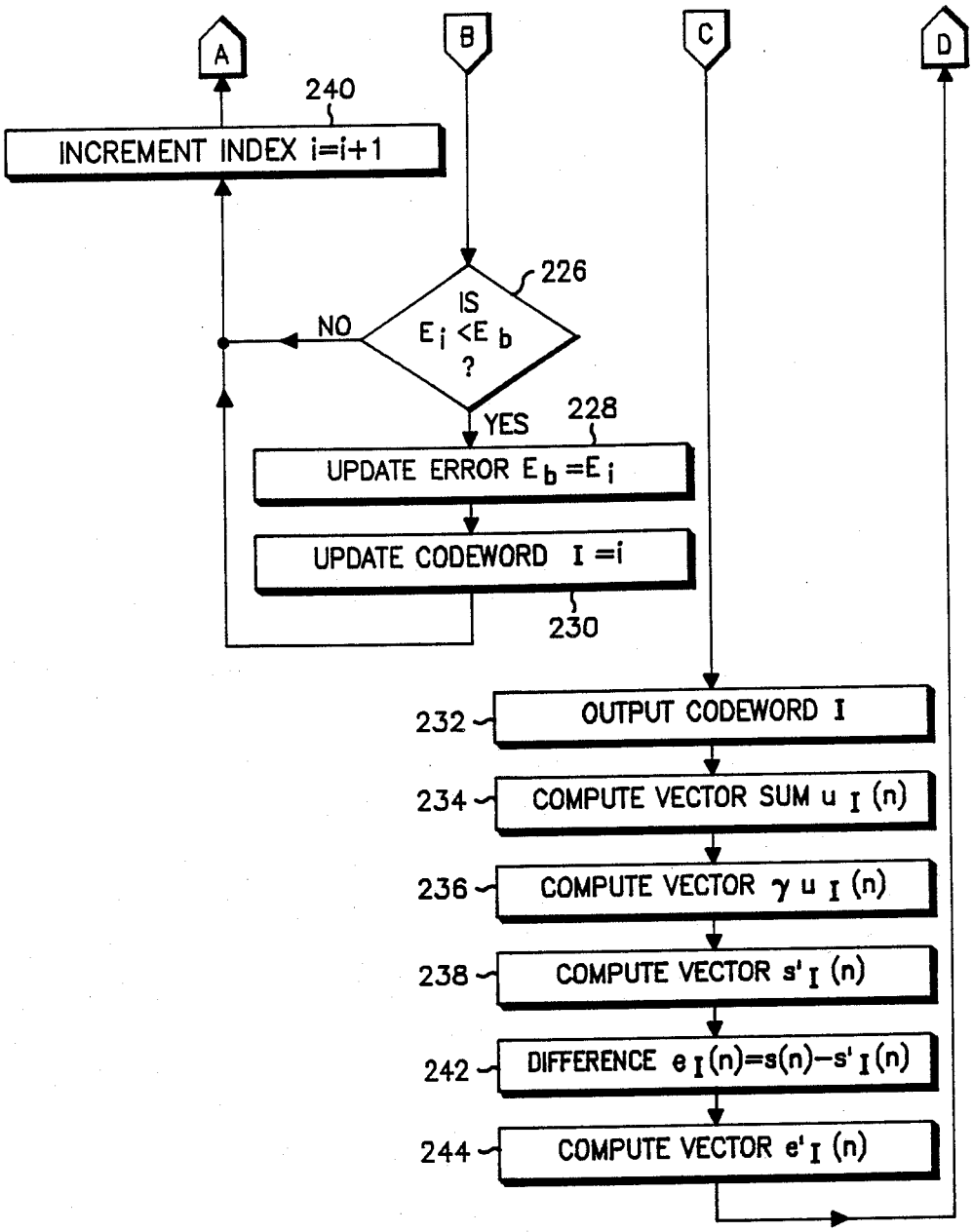

Continuing with step 216 of FIG. 2A, the excitation vector $u_i(n)$ is then multiplied by the excitation gain factor $\gamma$ via gain block 122. This scaled excitation vector $\gamma u_i(n)$ is then filtered in step 218 by the long term and short term predictor filters to compute the reconstructed speech vector $s'_i(n)$. The difference vector ei(n) is then calculated in step 220 by subtractor 130 such that:

$$e_i(n) = S(n) - s'_i(n) \qquad (2)$$

for all N samples, i.e., $1 \leqq n \leqq N$.

In step 222, weighting filter 132 is used to perceptually weight the difference vector $e_i(n)$ to obtain the weighted difference vector $e'_i(n)$. Energy calculator 134 then computes the energy $E_i$ of the weighted difference vector in step 224 according to the equation:

$$E_i = \sum_{n=1}^{N} [e'_i(n)]^2 \qquad \{3\}$$

Step 226 compares the i-th error signal to the previous best error signal $E_b$ to determine the minimum error. If the present index i corresponds to the minimum error signal so far, then the best error signal $E_b$ is updated to the value of the i-th error signal in step 228, and, accordingly, the best codeword I is set equal to i in step 230. The codeword index i is then incremented in step 240, and control returns to step 210 to test the next code vector.

When all $2^M$ code vectors have been tested, control proceeds from step 212 to step 232 to output the best codeword I. The process is not complete until the actual filter states are updated using the best codeword I. Accordingly, step 234 computes the excitation vector $u_I(n)$ using the vector sum technique as was done in step 216, only this time utilizing the best codeword I. The excitation vector is then scaled by the gain factor $\gamma$ in 236, and filtered to compute reconstructed speech vector $s'_I(n)$ in step 238. The difference signal $e_I(n)$ is then computed in step 242, and weighted in step 244 so as to update the weighting filter state. Control is then returned to step 202.

Figure 4:
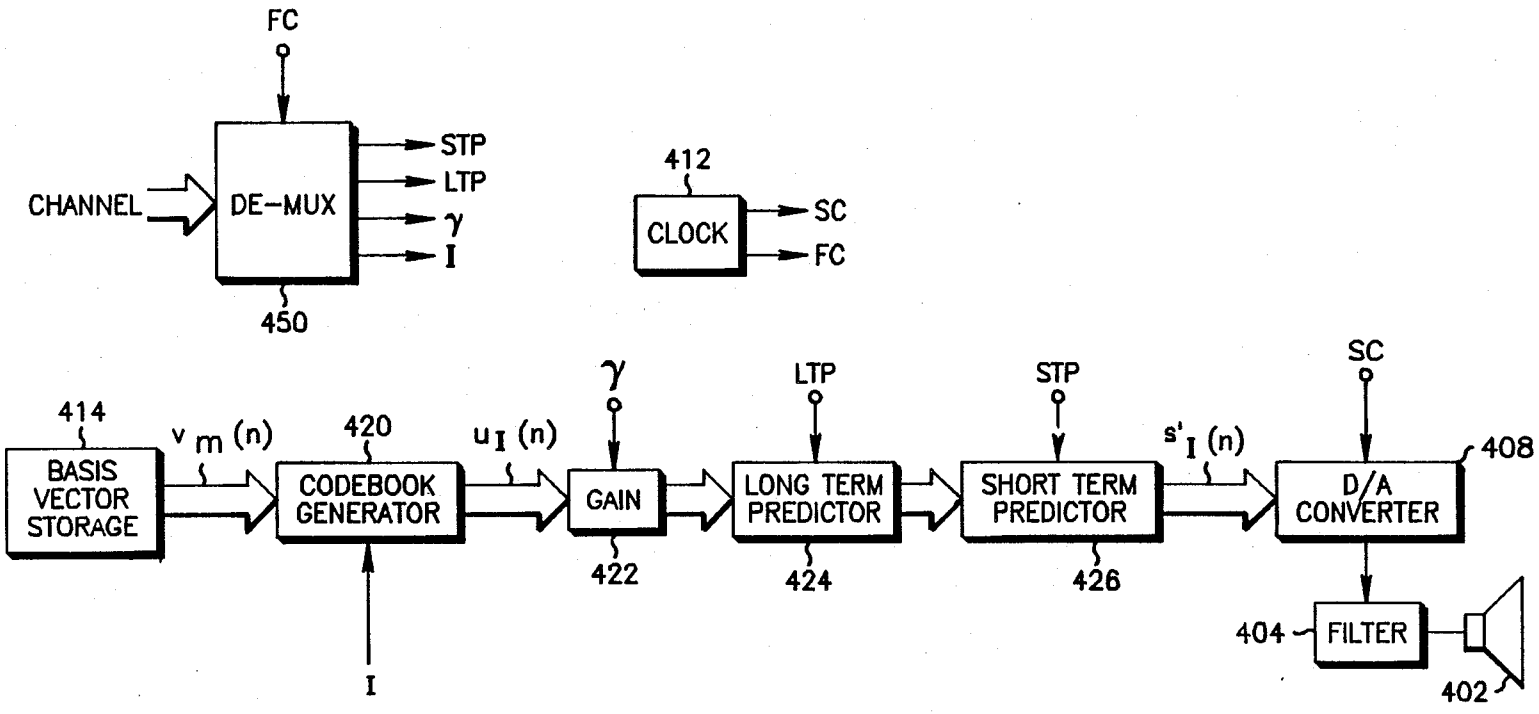
FIG. 4 is a general block diagram of a speech synthesizer using the present invention.

Referring now to FIG. 4, a speech synthesizer block diagram is illustrated also using the vector sum generation technique according to the present invention. Synthesizer 400 obtains the short term predictor parameters STP, long term predictor parameters LTP, excitation gain factor $\gamma$, and the codeword I received from the channel, via de-multiplexer 450. The codeword I is applied to codebook generator 420 along with the set of basis vectors $v_m(n)$ from basis vector storage 414 to generate the excitation vector $u_I(n)$ as described in FIG. 3. The single excitation vector $u_I(n)$ is then multiplied by the gain factor $\gamma$ in block 422, filtered by long term predictor filter 424 and short term predictor filter 426 to obtain reconstructed speech vector $s'_I(n)$. This vector, which represents a frame of reconstructed speech, is then applied to analog-to-digital (A/D) convertor 408 to produce a reconstructed analog signal, which is then low pass filtered to reduce aliasing by filter 404, and applied to an output transducer such as speaker 402. Clock 412 generates the sample clock and the frame clock for synthesizer 400.

Figure 5:
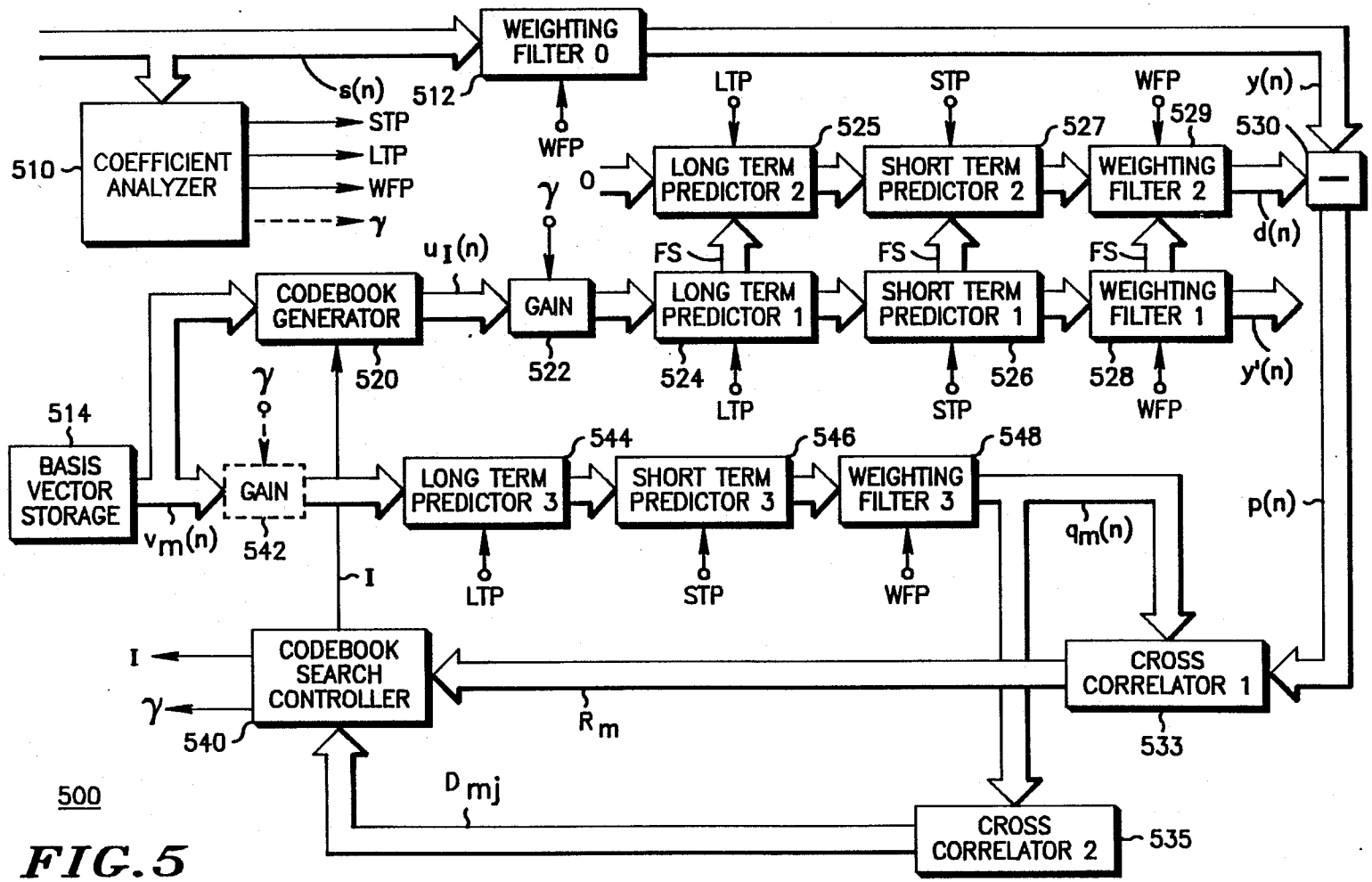
FIG. 5 is a partial block diagram of the speech coder of FIG. 1, illustrating the improved search technique according to the preferred embodiment of the present invention.

Referring now to FIG 5, a patial block diagram of an alternate embodiment of the speech coder of FIG. 1 is shown so as to illustrate the preferred embodiment of the invention. Note that there are two important differences from speech coder 100 of FIG. 1. First, codebook search controller 540 computes the gain factor $\gamma$ itself in conjunction with the optimal codeword I search and the excitation gain factor $\gamma$ generation will be described in the corresponding flowchart of FIG. 6 Secondly, note that a further alternate embodiment would be to use predetermined gains calculated by coefficient analyzer 510. The flowchart of FIG. 7 describes such an embodiment. FIG. 7 may be used to describe that block diagram of FIG. 5 if the additional gain block 542 and gain factor output of coefficient analyzer 510 are inserted, as shown in dotted lines.

Before proceeding with the detailed description of the operation of speech coder 500, it may prove helpful to provide an explanation of the basic search approach taken by th present invention. In the standard CELP speech coder, the difference vector from equation {2}:

$$e_i(n) = s(n) - s'_i(n) \qquad \{2\}$$

was weighted to yield $e'_i(n)$, which was then used to calculate the error signal according to the equation:

$$E_i = \sum_{n=1}^{N} [e'_i(n)]^2 \qquad \{3\}$$

which was minimized in order to determine the desired codeword I. All $2^M$ excitation vectors had to be evaluated to try and find the best match to s(n). This was the basis of the exhaustive search strategy.

In the preferred embodiment, it is necessary to take into account the decaying response of the filters. This is done by initializing the filters with filter states existing at the start of the frame, and letting the filters decay with no external input. The output of the filters with no input is called the zero input response Furthermore, the weighting filter function can be moved from its conventional location at the output of the subtractor to both input paths of the subtractor. Hence, if d(n) is the zero input response vector of the filters, and if y(n) is the weighted input speech vector, then the difference vector p(n) is:

$$p(n) = y(n) - d(n). \qquad \{4\}$$

Thus, the initial filter states are totally compensated for by subtracting off the zero input response of the filters.

The weighted difference vector $e'_i(n)$ becomes:

$$e'_i(n)=p(n)-s'_i(n). \quad \{5\}$$

However, since the gain factor $\gamma$ is to be optimized at the same time as searching for the optimum codeword, the filtered excitation vector $f_i(n)$ must be multiplied by each codeword's gain factor $\gamma_i$ to replace $s'_i(n)$ in equation {5}, such that it becomes:

$$e'_i(n)=p(n)-\gamma_i f_i(n). \quad \{6\}$$

The filtered excitation vector $f_i(n)$ is the filtered version of $u_i(n)$ with the gain factor $\gamma$ set to one, and with the filter states initialized to zero. In other words, $f_i(n)$ is the zero state response of the filters excited by code vector $u_i(n)$. The zero stats response is used since the filter state information was already compensated for by the zero input response vector d(n) in equation {4}.

Using the value for $e'_i(n)$ from equation {6} in equation {3} gives:

$$E_i = \sum_{n=1}^{N} [p(n) - \gamma_i f_i(n)]^2 \quad \{7\}$$

Expanding equation {7} produces:

$$E_i = \sum_{n=1}^{N} p(n)^2 - 2\gamma_i \sum_{n=1}^{N} f_i(n)p(n) + \gamma_i^2 \sum_{n=1}^{N} f_i(n)^2 \quad \{8\}$$

Defining the cross-correlation between $f_i(n)$ and p(n) as:

$$C_i = \sum_{n=1}^{N} f_i(n)\, p(n) \quad \{9\}$$

and defining the energy in the filtered code vector $f_i(n)$ as:

$$G_i = \sum_{n=1}^{N} [f_i(n)]^2 \quad \{10\}$$

permits simplying equation {8} as:

$$E_i = \sum_{n=1}^{N} p(n)^2 - 2\gamma_i C_i + \gamma_i^2 G_i \quad \{11\}$$

We now want to determine the optimal gain factor $\gamma_i$ which will minimize $E_i$ in equation {11}. Taking the partial derivative of $E_i$ with respect to $\gamma_i$ and setting it equal to zero permits solving for the optimal gain factor $\gamma_i$. This procedure yields:

$$\gamma_i = C_i/G_i \quad \{12\}$$

which, when substituted into equation {11} gives:

$$E_i = \sum_{n=1}^{N} p(n)^2 - [C_i]^2/G_i \quad \{13\}$$

It can now be seen that to minimize the error $E_i$ in equation {13}, the term $[C_i]^2/G_i$ must be maximized. The technique of codebook searching which maximizes $[C_i]^2/G_i$ will be described in the flowchart of FIG. 6.

If the gain factor $\gamma$ is pre-calculated by coefficient analyzer 510, then equation {7} can be rewritten as:

$$E_i = \sum_{n=1}^{N} p(n)^2 - 2 \sum_{n=1}^{N} y'_i(n)p(n) + \sum_{n=1}^{N} y'_i(n)^2 \quad \{14\}$$

where $y'_i(n)$ is the zero state response of the filters to excitation vector $u_i(n)$ multiplied by the predetermined gain factor $\gamma$. If the second and third terms of equation {14} are re-defined as:

$$C_i = \sum_{n=1}^{N} y'_i(n)\, p(n) \quad \{15\}$$

and:

$$G_i = \sum_{n=1}^{N} [y'_i(n)]^2 \quad \{16\}$$

respectively, then equation {14} can be reduced to:

$$E_i = \sum_{n=1}^{N} p(n)^2 - 2C_i + G_i. \quad \{17\}$$

In order to minimize $E_i$ in equation {17} for all codewords, the term $[-2C_i+G_i]$ must be minimized. This is the codebook searching technique which will be described in the flowchart of FIG. 7.

Recalling that the present invention utilizes the concept of basis vectors to generate $u_i(n)$, the vector sum equation:

$$u_i(n) = \sum_{m=1}^{M} \theta_{im}\, v_m(n) \quad \{1\}$$

can be used for the substitution of $u_i$ as will be shown later. The essence of this substitution is that the basis vectors $v_m(n)$ can be utilized once each frame to directly pre-compute all of the terms required for the search calculations. This permits the present invention to evaluate each of the $2^M$ codewords by performing a series of multiply-accumulate operations that is linear in M. In the preferred embodiment, only M+3 MACs are required.

Figure 6A:
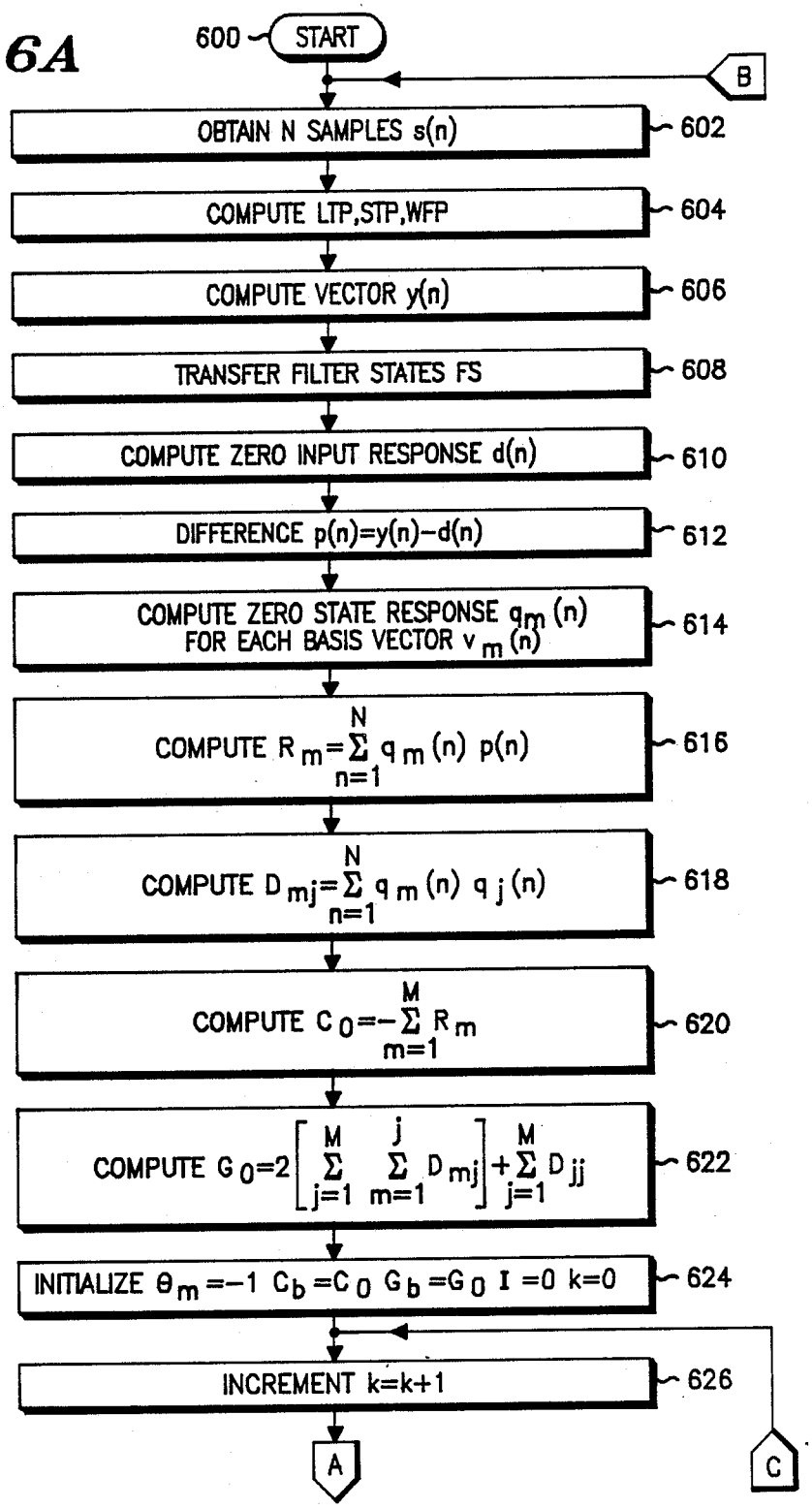
FIGS. 6A/6B is a detailed flowchart diagram illustrating the sequence of operations performed by the speech coder of FIG. 5, implementing the gain calculation technique of the preferred embodiment.
Figure 6B:
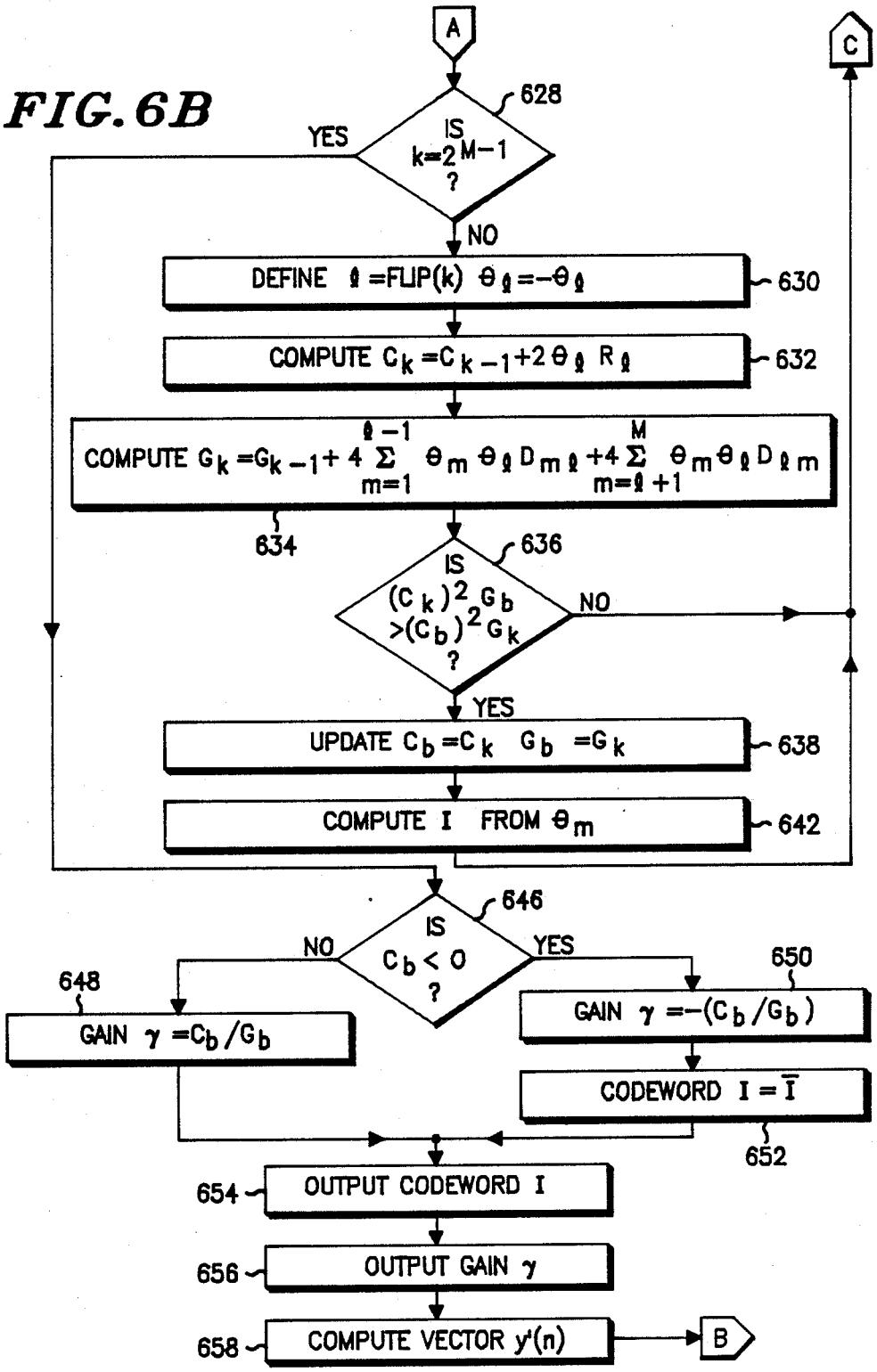

FIG. 5, using optimized gains, will now be described in terms of its operation, which is illustrated in the flowchart of FIGS. 6A and 6B. Beginning at start 600, one frame of N input speech samples s(n) is obtained in step 602 from the analog-to-digital converter, as was done in FIG. 1. Next, the input speech vector s(n) is applied to coefficient analyzer 510, and is used to compute the short term predictor parameters STP, long term predictor parameters LTP, and weighting filter parameters WFP in step 604. Note that coefficient analyzer 510 does not compute a predetermined gain factor $\gamma$ in this embodiment, as illustrated by the dotted arrow. The input speech vector s(n) is also applied to initial weighting filter 512 so as to weight the input speech frame to generate weighted input speech vector y(n) in step 606. As mentioned above, the weighting filters perform the same function as weighting filter 132 of FIG. 1, except that they can be moved from the conventional location at the output of subtractor 130 to both inputs of the subtractor. Note that vector y(n) actually represents a set of N weighted speech vectors, wherein $1 \leqq n \leqq N$ and wherein N is the number of samples in the speech frame.

In step 608, the filter states FS are transferred from the first long term predictor filter 524 to second long term predictor filter 525, from first short term predictor filter 526 to second short term predictor filter 527, and from first weighting filter 528 to second weighting filter 529. These filter states are used in step 610 to compute the zero input response d(n) of the filters. The vector d(n) represents the decaying filter state at the beginning of each frame of speech. The zero input response vector d(n) is calculated by applying a zero input to the second filter string 525, 527, 529, each having the respective filter states of their associated filters 524, 526, 528, of the first filter string. Note that in a typical implementation, the function of the long term predictor filters, short term predictor filters, and weighting filters can be combined to reduce complexity.

In step 612, the difference vector p(n) is calculated in subtractor 530. Difference vector p(n) represents the difference between the weighted input speech vector y(n) and the zero input response vector d(n), previously described by equation {4}:

$$p(n)=y(n)-d(n). \qquad \{4\}$$

The difference vector p(n) is then applied to the first cross-correlator 533 to be used in the codebook searching process.

In terms of achieving the goal of maximizing $[C_i]^2/G_i$ as stated above, this term must be evaluated for each of the $2^M$ codebook vectors—not the M basis vectors. However, this parameter can be calculated for each codeword based on parameters associated with the M basis vectors rather than the $2^M$ code vectors. Hence, the zero state response vector $q_m(n)$ must be computed for each basis vector $v_m(n)$ in step 614. Each basis vector $v_m(n)$ from basis vector storage block 514 is applied directly to third long term predictor filter 544 (without passing through gain block 542 in this embodiment). Each basis vector is then filtered by filter series #3, comprising long term predictor filter 544, short term predictor filter 546, and weighting filter 548. Zero state response vector $q_m(n)$, produced at the output of filter series #3, is applied to first cross-correlator 533 as well as second cross-correlator 535.

In step 616, the first cross-correlator computes cross-correlation array $R_m$ according to the equation:

$$R_m = \sum_{n=1}^{N} q_m(n)\, p(n). \qquad \{18\}$$

Array $R_m$ represents the cross-correlation between the m-th filtered basis vector qm(n) and p(n). Similarly, the second cross-correlator computes cross-correlation matrix $D_{mj}$ in step 618 according to the equation:

$$D_{mj} = \sum_{n=1}^{N} q_m(n)\, q_j(n) \qquad \{19\}$$

where $1 \leqq m \leqq j \leqq M$. Matrix $D_{mj}$ represents the cross-correlation between pairs of individual filtered basis vectors. Note that $D_{mj}$ is a symmetric matrix. Therefore, approximately half of the terms need only be evaluated as shown by the limits of the subscripts.

The vector sum equation from above:

$$u_i(n) = \sum_{m=1}^{M} \theta_{im}\, v_m(n) \qquad \{1\}$$

can be used to derive $f_i(n)$ as follows:

$$f_i(n) = \sum_{m=1}^{M} \theta_{im}\, q_m(n) \qquad \{20\}$$

where $f_i(n)$ is the zero state response of the filters to excitation vector $u_i(n)$, and where $q_m(n)$ is the zero state response of the filters to basis vector $v_m(n)$. Equation }9}:

$$C_i = \sum_{n=1}^{N} f_i(n)\, p(n) \qquad \{9\}$$

can be rewritten using equation {20} as:

$$C_i = \sum_{m=1}^{M} \theta_{im} \sum_{n=1}^{N} q_m(n)\, p(n). \qquad \{21\}$$

Using equation {18}, this can be simplified to:

$$C_i = \sum_{m=1}^{M} \theta_{im}\, R_m. \qquad \{22\}$$

For the first codework, where i=0, all bits are zero. Therefore, $\theta_{Om}$ for $1 \leqq m \leqq M$ equals −1 as previously discussed. The first correlation CO, which is just $C_i$ from equation {22} where i=0, then becomes:

$$C_0 = -\sum_{m=1}^{M} R_m. \qquad \{23\}$$

which is computed in step 620 of the flowchart. Using $q_m(n)$ and equation {20}, the energy term $G_i$ may also be rewritten from equation {10}:

$$G_i = \sum_{n=1}^{N} [f_i(n)]^2 \qquad \{10\}$$

into the following:

$$G_i = \sum_{n=1}^{N} \left[ \sum_{m=1}^{M} \theta_{im}\, q_m(n) \right]^2 \qquad \{24\}$$

which may be expanded to be:

$$G_i = \sum_{j=1}^{M} \sum_{m=1}^{M} \theta_{im}\theta_{ij} \sum_{n=1}^{N} q_m(n)\, q_j(n). \qquad \{25\}$$

Substituting by using equation {19} yields:

$$G_i = 2 \sum_{j=1}^{M} \sum_{m=1}^{j} \theta_{im}\theta_{ij}\, D_{mj} + \sum_{j=1}^{M} D_{jj}. \qquad \{26\}$$

By noting that a codeword and its complement, i.e., wherein all the codeword bits are inverted, both have the same value of $[C_I]^2/G_i$, both code vectors can be evaluated at the same time. The codeword computations are then halved Thus, using equation {26} evaluated for i=0, the first energy term $G_0$ becomes $$G_0 = 2 \sum_{j=1}^{M} \sum_{m=1}^{j} D_{mj} + \sum_{j=1}^{M} D_{jj} \quad \{27\}$$

which is computed in step 622 Hence, up to this step, we have computed the correlation term $C_0$ and the energy term $G_0$ for codeword zero.

Continuing with step 624, the parameters $\theta_{im}$ are initialized to $-1$ for $1 \leqq m \leqq M$. These $\theta_{im}$ was parameters represent the M interim data signals which would be used to generate the current code vector as described by equation {1}. (The i subscript in $\theta_{im}$ was dropped in the figures for simplicity.) Next, the best correlation term $C_b$ is set equal to the pre-calculated correlation $C_0$, and the best energy term $G_b$ is set equal to the pre-calculated $G_0$. The codeword I, which represents the codeword for the best excitation vector $u_I(n)$ for the particular input speech frame s(n), is set equal to 0. A counter variable k is initialized to zero, and is then incremented in step 626.

In FIG. 6B, the counter k is tested in step 628 to see if all $2^M$ combinations of basis vectors have been tested. Note that the maximum value of k is $2^{M-1}$, since a codeword and its complement are evaluated at the same time as described above. If k is less than $2^{M-1}$, then step 630 proceeds to define a function "flip" wherein the variable l represents the location of the next bit to flip in codeword i. This function is performed since the present invention utilizes a Gray code to sequence through the code vectors changing only one bit at a time. Therefore, it can be assumed that each successive codeword differs from the previous codeword in only one bit position. In other words, if each successive codeword evaluated differs from the previous codeword by only one bit, which can be accomplished by using a binary Gray code approach, then only M add or subtract operations are needed to evaluate the correlation term and energy term. Step 630 also sets $\theta_l$ to $-\theta_l$ to reflect the change of bit l in the codeword.

Using this Gray code assumption, the new correlation term $C_k$ is computed in step 632 according to the equation:

$$c_k = c_{k-1} + 2\theta_l R_l \quad \{28\}$$

This was derived from equation {22} by substituting $-\theta_l$ for $\theta_l$.

Next, in step 634, the new energy term $G_k$ is computed according to the equation:

$$G_k = G_{k-1} + 4 \sum_{m=1}^{l-1} \theta_m \theta_l D_{ml} + 4 \sum_{m=l+1}^{M} \theta_m \theta_l D_{lm}, \quad \{29\}$$

which assumes that $D_{jk}$ is stored as a symmetric matrix with only values for $j \leqq k$ being stored. Equation {29} was derived from equation {26} in the same manner.

Once $G_k$ and $C_k$ have been computed, then $[C_k]^2/G_k$ must be compared to the previous best $[C_b]^2/G_b$. Since division is inherently slow, it is useful to reformulate the problem to avoid the division by cross multiplication. Since all terms are positive, this equation is equivalent to comparing $[C_k]^2 \times G_b$ to $[C_b]^2 \times G_k$, as is done in step 636. If the first quantity is greater than the second quantity, then control proceeds to step 638, wherein the best correlation term $C_b$ and the best energy term $G_b$ are updated, respectively. Step 642 computes the excitation codeword I from the $\theta_m$ parameter by setting bit m of codeword I equal to 1 if $\theta_m$ is $+1$, and by setting bit m of codeword I equal to 0 if $\theta_m$ is $-1$, for all m bits $1 \leqq m \leqq M$. Control then returns to step 626 to test the next codeword, as would be done immediately if the first quantity was not greater than the second quantity.

Once all the pairs of complementary codewords have been tested and the codeword which maximizes the $[C_b]^2/G_b$ quantity has been found, control proceeds to step 646, which checks to see if the correlation term $C_b$ is less than zero. This is done to compensate for the fact that the codebook was searched by pairs of complementary codewords. If $C_b$ is less than zero, then the gain factor $\gamma$ is set equal to $-[C_b/G_b]$ in step 650, and the codeword I is complemented in step 652. If $C_b$ is not negative, then the gain factor $\gamma$ is just set equal to $C_b/G_b$ in step 648. This ensures that the gain factor $\gamma$ is positive.

Next, the best codeword I is output in step 654, and the gain factor $\gamma$ is output in step 656. Step 658 then proceeds to compute the reconstructed weighted speech vector y'(n) by using the best excitation codeword I. Codebook generator uses codeword I and the basis vectors $v_m(n)$ to generate excitation vector $u_I(n)$ according to equation {1}. Code vector $u_I(n)$ is then scaled by the gain factor $\gamma$ in gain block 522, and filtered by filter string #1 to generate y'(n). Speech coder 500 does not use the reconstructed weighted speech vector y'(n) directly as was done in FIG. 1. Instead, filter string #1 is used to update the filter states FS by transferring them to filter string #2 to compute the zero input response vector d(n) for the next frame. Accordingly, control returns to step 602 to input the next speech frame s(n).

In the search approach described in FIGS. 6A/6B, the gain factor $\gamma$ is computed at the same time as the codeword I is optimized. In this way, the optimal gain factor for each codeword can be found. In the alternative search approach illustrated in FIGS. 7A through 7C, the gain factor is pre-computed prior to codeword determination. Here the gain factor is typically based on the RMS value of the residual for that frame, as described in B. S. Atal and M. R. Schroeder, "Stochastic Coding of Speech Signals at Very Low Bit Rates", Proc. Int. Conf. Commun., Vol. ICC84, Pt. 2, pp. 1610–1613, May 1984. The drawback in this pre-computed gain factor approach is that it generally exhibits a slightly inferior signal-to-noise ratio (SNR) for the speech coder.

Figure 7A:
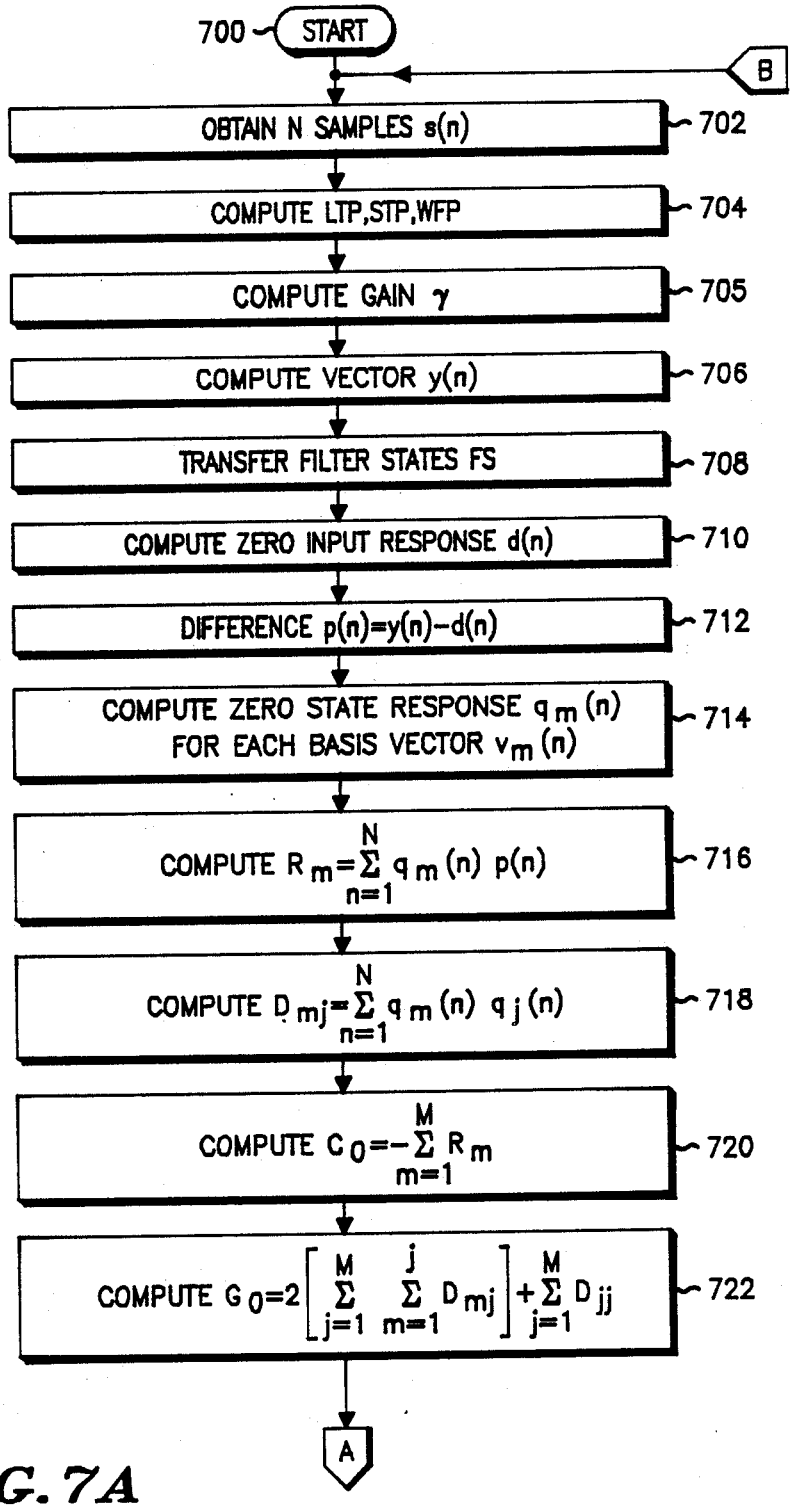
FIGS. 7A/7B/7C is a detailed flowchart diagram illustrating the sequence of operations performed by an alternate embodiment of FIG. 5, using a pre-computed gain technique.
Figure 7B:
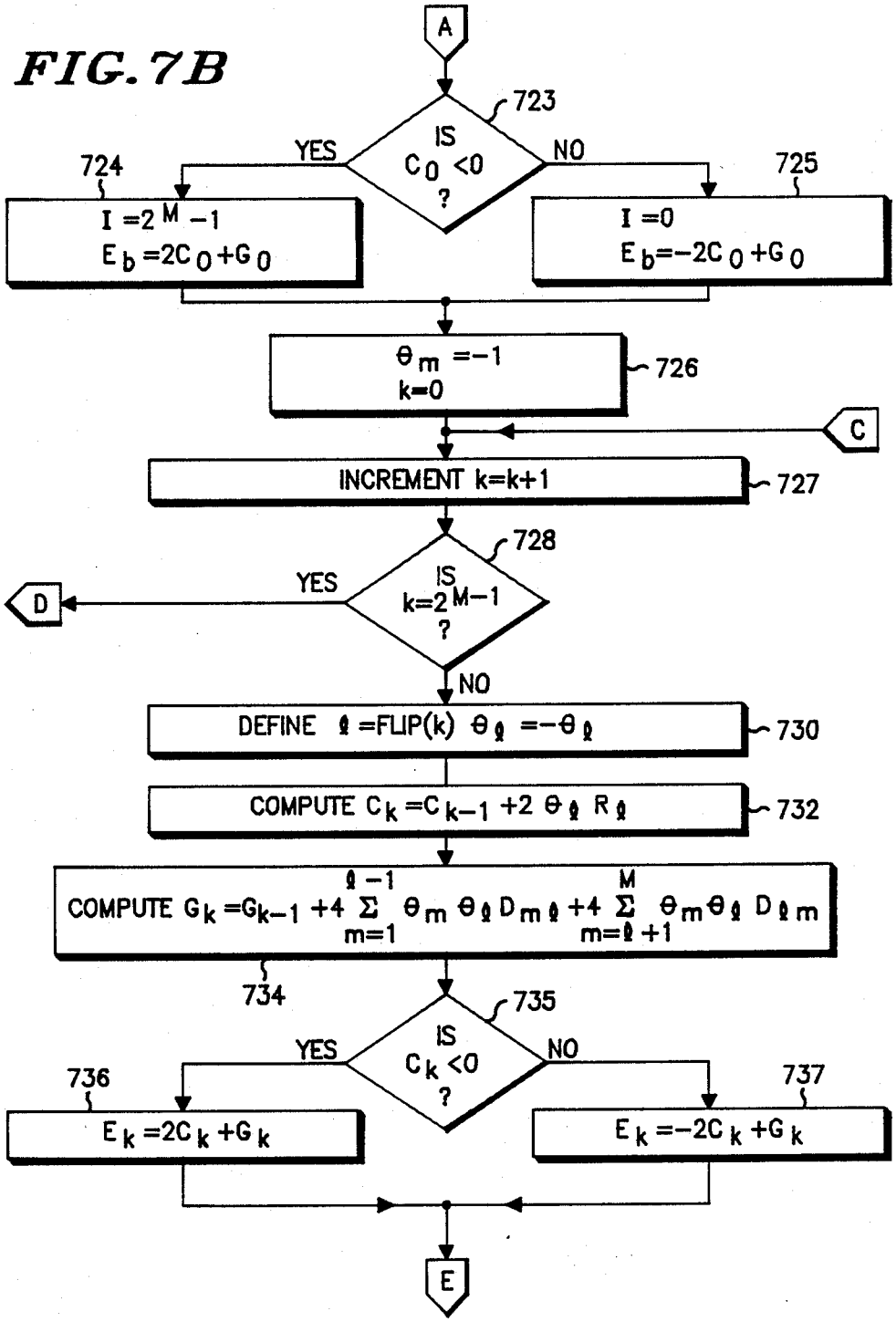

Referring now to the flowchart of FIG. 7A, the operation of speech coder 500 using predetermined gain factors will now be described. The input speech frame vector s(n) is first obtained from the A/D in step 702, and the long term predictor parameters LTP, short term predictor parameters STP, and weighting filter parameters WTP are computed by coefficient analyzer 510 in step 704, as was done in steps 602 and 604, respectively. However, in step 705, the gain factor 7 is now computed for the entire frame as described in the preceding reference. Accordingly, coefficient analyzer 510 would output the predetermined gain factor 7 as shown by the dotted arrow in FIG. 5, and gain block 542 must be inserted in the basis vector path as shown by the dotted lines.

Steps 706 through 712 are identical to steps 606 through 612 of FIG. 6A, respectively, and should require no further explanation. Step 714 is similar to step 614, except that the zero state response vectors $q_m(n)$ are computed from the basis vectors vm(n) after multiplication by the gain factor $\gamma$ in block 542. Steps 716 through 722 are identical to steps 616 through 622, respectively. Step 723 tests whether the correlation $C_O$ is less than zero in order to determine how to initialize the variables I and $E_b$. If $C_0$ is less than zero, then the best codeword I is set equal to the complementary codeword $I=_2M-1$, since it will provide a better error signal $E_b$ than codeword $I=0$. The best error signal $E_b$ is then set equal to $2C_O+G_0$, sinc $C_{2M-1}$ is equal to $-C_0$. If $C_0$ is not negative, then step 725 initializes I to zero and initializes $E_b$ to $-2C_0+G_0$, as shown.

Step 726 proceeds to initialize the interim data signals $\theta_m$ to $-1$, and the counter variable k to zero, as was done in step 624. The variable k is incremented in step 727, and tested in step 728, as done in step 626 and 628, respectively. Steps 730, 732, and 734 are identical to steps 630, 632, and 634, respectively. The correlation term $C_k$ is then tested in step 735. If it is negative, the error signal $E_k$ is set equal to $2C_k+G_k$, since a negative $C_k$ similarly indicates that the complementary codeword is better than the current codeword. If $C_k$ is positive, step 737 sets $E_k$ equal to $-2C_k+G_k$, as was done before.

Figure 7C:
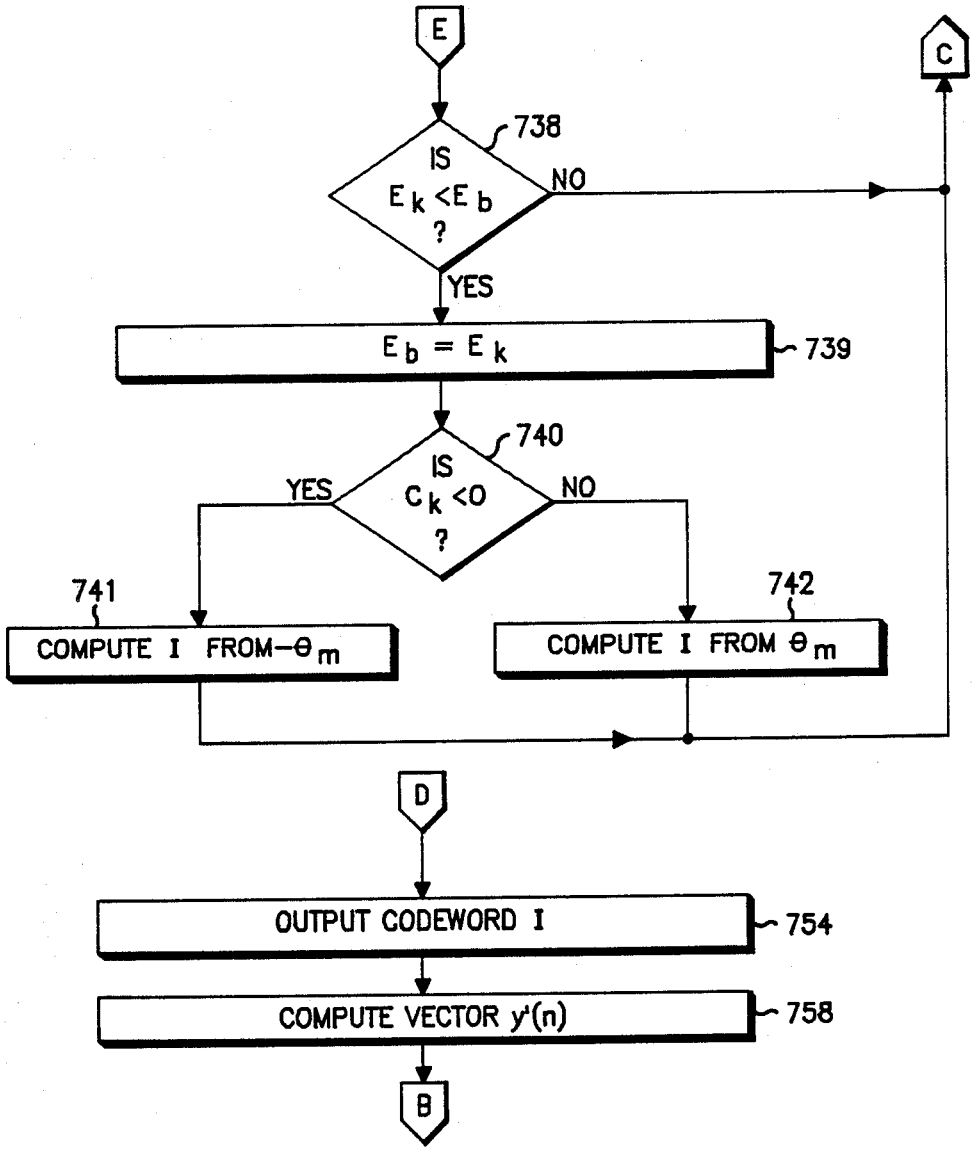

Continuing with FIG. 7C, step 738 compares the new error signal $E_k$ to the previous best error signal $E_b$. If $E_k$ is less than $E_b$, then $E_b$ is updated to $E_k$ in step 739. If not, control returns to step 727. Step 740 again tests the correlation $C_k$ to see if it is less than zero. If it is not, the best codeword I is computed from $\theta_m$ as was done in step 642 of FIG. 6B. If $C_k$ is less than zero, I is computed from $-\theta_m$ in the same manner to obtain the complementary codeword. Control returns to step 727 after I is computed.

When all $2^M$ codewords have been tested, step 728 directs control to step 754, where the codeword I is output from the search controller. Step 758 computes the reconstructed weighted speech vector y'(n) as was done in step 658. Control then returns to the beginning of the flowchart at step 702.

In sum, the present invention provides an improved excitation vector generation and search technique that can be used with or without predetermined gain factors. The codebook of $2^M$ excitation vectors is generated from a set of only M basis vectors. The entire codebook can be searched using only M+3 multiply-accumulate operations per code vector evaluation. This reduction in storage and computational complexity makes possible real-time implementation of CELP speech coding with today's digital signal processors.

While specific embodiments of the present invention have been shown and described herein, further modifications and improvements may be made without departing from the invention in its broader aspects. For example, any type of basis vector may be used with the vector sum technique described herein. Moreover, different computations may be performed on the basis vectors to achieve the same goal of reducing the computational complexity of the codebook search procedure. All such modifications which retain the basic underlying principles disclosed and claimed herein are within the scope of this invention.

What is claimed is:

1. A means for providing a set of $2^M$ codebook vectors for a vector quantizer, said codebook vector providing means comprising:

memory means for storing said set of codebook vectors, said set of stored codebook vectors formed by:

converting a set of selector codewords into a plurality of interim data signals; inputting a set of M basis vectors;

multiplying said set of basis vectors by said plurality of interim data signals to produce a plurality of interim vectors; and summing said plurality of interim vectors to produce said set of codebook vectors;

means for addressing said memory means with a particular codeword; and means for outputting a particular codebook vector from said memory means when addressed with said particular codeword.

2. The codebook vector providing means according to claim 1, wherein said converting step produces said plurality of interim data signals $\theta_{im}$ by identifying the state of each bit of each selector codeword i, where $0 \leqq i \leqq 2^{M-1}$, and where $1 \leqq m \leqq M$, such that $\theta_{im}$ has a first value if bit m of codeword i is of a first state, and such that $\theta_{im}$ has a second value if bit m of codeword i is of a second state.

3. The codebook vector providing means according to claim 1, wherein said set of basis vectors is stored in a memory.

4. A digital memory containing a codebook of excitation vectors for use in speech analysis or synthesis, said codebook having at least $2^M$ excitation vectors ui(n), each having N elements, where $1 \leqq n \leqq N$, and where $0 \leqq i \leqq 2^{M-1}$, said codebook vectors generated from a set of M basis vectors $v_m(n)$, each having N elements, where $1 \leqq n \leqq N$ and where $1 \leqq m \leqq M$, and from a set of $2^M$ digital codewords $I_i$, each having M bits, where $0 \leqq i \leqq 2^{M-1}$, said codebook vectors generated using the steps of:

}a} identifying a signal $\theta_{im}$ for each bit of each codeword $I_i$, such that $\theta_{im}$ has a first value if bit m of codeword $I_i$ is of a first state, and such that $\theta_{im}$ has a second value if bit m of codeword $I_i$ is of a second state; and {b} calculating said codebook of $2^M$ excitation vectors $u_i(n)$ according to the equation:

$$u_i(n) = \sum_{m=1}^{M} \theta_{im}\, v_m(n)$$

where $1 \leqq n \leqq N$.

where $1 \leqq n \leqq N$.

5. A method of reconstructing a signal from a codebook memory and from a particular excitation codeword, said signal reconstructing method comprising the steps of:

{a} addressing a codebook memory with a particular codeword, said codebook memory having a set of excitation vectors stored therein, each of said excitation vectors having been produced by:

{1} defining a plurality of interim data signals based upon said particular codeword;

{2} multiplying a set of basis vectors by said plurality of interim data signals to produce a plurality of interim vectors; and {3} summing said plurality of interim vectors to produce a single excitation vector;

{b} outputting, from said codebook memory, a particular excitation vector corresponding to the particular addressing codeword; and {c} signal processing said particular excitation vector to produce said reconstructed signal.

6. The method according to claim 5, wherein said set of basis vectors is stored in memory.

7. The method according to claim 5 wherein said signal processing step includes linear filtering of said particular excitation vector.

8. The method according to claim 5, wherein said defining step produces said plurality of interim data signals $\theta_{im}$ by identifying the state of each bit of said particular codeword i, where $0 \leqq i \leqq 2^{M-1}$, and where $1 \leqq m \leqq M$, such that $\theta_{im}$ has a first value if bit m of codeword i is of a first state, and such that $\theta_{im}$ has a second value if bit m of codeword i is of a second state.

9. A speech coder comprising:

input means for providing an input vector corresponding to a segment of input speech;

means for providing a set of codewords corresponding to a set of Y possible excitation vectors;

memory means for storing said set of Y possible excitation vectors and for providing a particular excitation vector in response to a particular codeword, each of said set of excitation vectors having been produced by:

{a} defining at least one selector codeword;

{b} defining a plurality of interim data signals based upon said selector codeword;

{c} inputting a set of X basis vectors, where $X<Y$; and

{d} generating each of said excitation vectors by performing linear transformations on said X basis vectors, said linear transformations defined by said interim data signals;

said speech coder further comprising:

a first signal path including:

means for filtering said excitation vectors;

means for comparing said filtered excitation vectors to said input vector, thereby providing comparison signals; and controller means for evaluating said set of codewords and said comparison signals, and for providing a particular codeword representative of a single excitation vector which, when passed through said first signal path, most closely resembles said input vector.

10. The speech coder according to claim 9, wherein said excitation vector generating step {d} includes the steps of:

{i} multiplying said set of X basis vectors by said plurality of interim data signals to produce a plurality of interim vectors; and {ii} summing said plurality of interim vectors to produce said excitation vectors.

11. The speech coder according to claim 9, wherein each of said selector codewords can be represented in bits, and wherein said interim data signals are based upon the value of each bit of each selector codeword.

12. The speech coder according to claim 9, wherein $Y>2^X$.

* * * * *

UNITED STATES PATENT AND TRADEMARK OFFICE

CERTIFICATE OF CORRECTION

PATENT NO. : 4,896,361

DATED : JAN. 23, 1990

INVENTOR(S) : IRA A. GERSON

It is certified that error appears in the above-identified patent and that said Letters Patent is hereby corrected as shown below:

COL. 16, LINE 48 IS A REPEATED LINE. PLEASE DELETE "WHERE $1 \leqq N \leqq N$."

COL. 18, LAST LINE, "$Y>2^X$" SHOULD READ --$Y \geq 2^X$--.

Signed and Sealed this

Seventh Day of May, 1991

*Attest:*

HARRY F. MANBECK, JR.

*Attesting Officer*

*Commissioner of Patents and Trademarks*